US012491406B1

(12) United States Patent
Zhou

(10) Patent No.: US 12,491,406 B1
(45) Date of Patent: Dec. 9, 2025

(54) SHOULDER SWING AND CHEST PRESS COMBINATION EXERCISE MACHINE

(71) Applicant: SHIHE INC, Loveland, CO (US)

(72) Inventor: Bo Zhou, Zhejiang (CN)

(73) Assignee: SHIHE INC, Loveland, CO (US)

( * ) Notice: Subject to any disclaimer, the term of this patent is extended or adjusted under 35 U.S.C. 154(b) by 0 days.

(21) Appl. No.: 19/245,946

(22) Filed: Jun. 23, 2025

(51) Int. Cl.

| | |
|---|---|
| ***A63B 23/12*** | (2006.01) |
| ***A63B 21/00*** | (2006.01) |
| ***A63B 21/06*** | (2006.01) |
| ***A63B 23/02*** | (2006.01) |
| ***A63B 23/035*** | (2006.01) |

(52) U.S. Cl.
CPC ..... *A63B 23/1245* (2013.01); *A63B 21/0615* (2013.01); *A63B 21/4047* (2015.10); *A63B 23/02* (2013.01); *A63B 23/03541* (2013.01)

(58) Field of Classification Search
CPC ..... A63B 21/4047; A63B 21/0615; A63B 21/0616; A63B 21/0617; A63B 21/0085; A63B 21/0087; A63B 21/04; A63B 21/0442
See application file for complete search history.

(56) References Cited

U.S. PATENT DOCUMENTS 6,296,598 B1 * 10/2001 Boland ..... A63B 21/0004 482/126
6,387,024 B1 * 5/2002 Monti ..... A63B 23/03525 482/130
7,104,936 B2 * 9/2006 Karlstrom ..... A63B 21/0083 482/137
7,530,934 B2 * 5/2009 Garner ..... A63B 21/00 482/137
7,608,020 B2 * 10/2009 Mason ..... A63B 21/4005 482/97
8,033,960 B1 * 10/2011 Dalebout ..... A63B 23/03541 482/130
10,343,008 B2 * 7/2019 Pullins ..... A63B 23/03525
12,337,204 B2 * 6/2025 Byun ..... A63B 21/4033
2003/0092543 A1 * 5/2003 Giannelli ..... A63B 21/4035 482/99

(Continued)

OTHER PUBLICATIONS

"Mikolo Lateral Raise Attachment, 2-in-1 Lateral Raise & Chest Fly Machine, Power Rack Squat Rack Attachment with 1" Holes, Home Gym Upper Body Workout Equipment for Chest & Shoulders"(amazon.com) Feb. 21, 2025 Obtained from the internet URL:<https://www.amazon.com/dp/B0DY1BCC2Q>. Downloaded on Jun. 12, 2025.

(Continued)

*Primary Examiner* — Zachary T Moore
(74) *Attorney, Agent, or Firm* — Hawaii Patent Services; Nathaniel K. Fedde; Kenton N. Fedde

(57) ABSTRACT

The present disclosure relates to a shoulder swing and chest press combination exercise machine, comprising a frame; an adjustment mechanism disposed on the frame; a movement arm, one end of which is connected to the adjustment mechanism; a weight arm, one end of which is hinged to the frame; a rocker arm, which forms a linkage mechanism with the movement arm through the adjustment mechanism; and a linkage rod, both ends of which are hinged to the rocker arm and the weight arm, respectively.

20 Claims, 7 Drawing Sheets

(56) References Cited

U.S. PATENT DOCUMENTS

| | | | | |
|---|---|---|---|---|
| 2009/0209397 | A1* | 8/2009 | Miskech | A63B 23/0405 482/140 |
| 2023/0364464 | A1* | 11/2023 | An | A63B 23/02 |
| 2023/0381580 | A1* | 11/2023 | Kueker | A63B 23/03525 |
| 2024/0366990 | A1* | 11/2024 | Keiser | A63B 21/4045 |

OTHER PUBLICATIONS

"Mikolo Power Rack Lateral Raise Attachment, Compact Standing Lateral Raise Machine, 13 Adjustable Positions Shoulder Machine for 180LBS Weight Capacity"(walmart. com) Jan. 16, 2025 Obtained from the internet URL:<https://www.walmart.com/ip/Mikolo-Power-Rack-Lateral-Raise-Attachment-Compact-Standing-Machine-13-Adjustable-Positions-Shoulder-Machine-180LBS-Weight-Capacity/15060923069>.Downloaded on Jun. 12, 2025.

"Power Rack Lateral Raise Attachment, Compact Standing Lateral Raise Machine, 13 Adjustable Positions Shoulder Machine for 180LBS Weight Capacity"(temu.com) Jan. 29, 2025 Obtained from the internet URL:<https://www.temu.com/goods.html?goods_id=601100007946430>. Downloaded on Jun. 20, 2025.

"Rack Mounted Lateral Raise and Chest Fly"(gym-mikolo. com) Feb. 11, 2025 Obtained from the internet URL:<https://gym-mikolo.com/products/lateral-raise-chest-fly-attachment-Ir01>.Downloaded on Jun. 12, 2025.

* cited by examiner

SHOULDER SWING AND CHEST PRESS COMBINATION EXERCISE MACHINE

TECHNICAL FIELD

The present disclosure relates to the technical field of fitness equipment, particularly to a shoulder swing and chest press combination exercise machine.

BACKGROUND

With the continuous improvement of people's living standards and increasing health awareness, fitness exercises have become an important way for the public to maintain physical and mental well-being. There are numerous types of existing fitness equipment, but most can only meet the exercise needs of a single body part, such as focusing on shoulder or chest training.

For example, U.S. Pat. Nos. 7,166,066 and 7,070,544 propose swing-based exercise equipment. However, the motion trajectories of such traditional fitness equipment are fixed and cannot be flexibly adjusted according to user needs, making it difficult to meet personalized training requirements. This single-function design limits the possibility of users training a plurality of body parts on the same device, resulting in low training efficiency and the need for frequent equipment changes, which increases training time and space usage.

SUMMARY

The present disclosure provides a shoulder swing and chest press combination exercise machine to address the issues raised in the background above.

To achieve the above object, the present disclosure adopts the following technical solutions:

A shoulder swing and chest press combination exercise machine comprises a frame; an adjustment mechanism disposed on the frame; a movement arm, one end of which is connected to the adjustment mechanism; a weight arm, one end of which is hinged to the frame; a rocker arm, which forms a linkage mechanism with the movement arm through the adjustment mechanism; and a linkage rod, both ends of which are hinged to the rocker arm and the weight arm, respectively.

A shoulder swing and chest press combination exercise machine comprises a frame; an adjustment mechanism arranged on the frame; a movement arm, one end of which is connected to the adjustment mechanism; a weight arm, one end of which is hinged to the frame; a rocker arm, forming a linkage mechanism with the movement arm through the adjustment mechanism; a linkage rod, both ends of which are hinged to the rocker arm and the weight arm respectively; wherein the adjustment mechanism comprises a rotating disc arranged between the frame and the movement arm; and a rotating rod, one end of which passes through the rotating disc and is connected to the rocker arm, and the other end of which is connected to the movement arm; and a plug-in assembly, located on a side of the rotating disc away from the frame and connected to the rotating rod, wherein the plug-in assembly selectively fixes a connection position with the rotating disc.

A shoulder swing and chest press combination exercise machine comprises a frame; an adjustment mechanism arranged on the frame; a movement arm, one end of which is connected to the adjustment mechanism; a weight arm, one end of which is hinged to the frame; a rocker arm, forming a linkage mechanism with the movement arm through the adjustment mechanism; a linkage rod, both ends of which are hinged to the rocker arm and the weight arm respectively; wherein, the adjustment mechanism comprises a rotating disc arranged between the frame and the movement arm; a rotating rod, one end of which passes through the rotating disc and is connected to the rocker arm, and the other end of which is connected to the movement arm; a plug-in assembly, located on a side of the rotating disc away from the frame and connected to the rotating rod, wherein the plug-in assembly selectively fixes a connection position with the rotating disc; and a limit rod, one end of which is arranged between the rotating rod and the plug-in assembly, and the other end of which is movably arranged in an arc-shaped groove on a surface of the rotating disc for limiting a connection position between the plug-in assembly and the rotating disc.

The main solution of the present disclosure is as follows: when a pin is locked into a socket on the rotating disc, the movement arm, the rocker arm, the linkage rod, and the weight arm form a four-rod linkage mechanism. When the user pushes or pulls the movement arm, the motion is transmitted through the four-rod linkage mechanism, driving the weight arm to perform an arc-shaped movement, and the weight rod generates dynamic resistance under gravity. By adjusting the pin to insert into different sockets on the rotating disc, the angle of the rocker arm can be altered, thereby changing the motion trajectory of the movement arm to achieve shoulder swing or chest press motion. When the pin is pulled out, the movement arm disengages from the linkage mechanism and moves independently.

The multi-angle sockets on the rotating disc of the rotating rod cooperate with the pin. By inserting the pin into different sockets, the shoulder swing or chest press mode can be quickly switched without tools or complex operations, enabling rapid transition between the two training modes. Resistance is transmitted through rigid connections, ensuring precise matching of resistance and motion trajectory in both modes. During shoulder swing or chest press mode, the arc-shaped movement of the rocker arm drives the weight arm through the linkage rod to generate progressive resistance.

BRIEF DESCRIPTION OF DRAWINGS

The drawings, which form part of this application, are provided to further illustrate the present disclosure. The illustrative embodiments and the descriptions thereof are intended to explain the present disclosure and do not constitute any undue limitation thereof. In the drawings.

Figure 1:
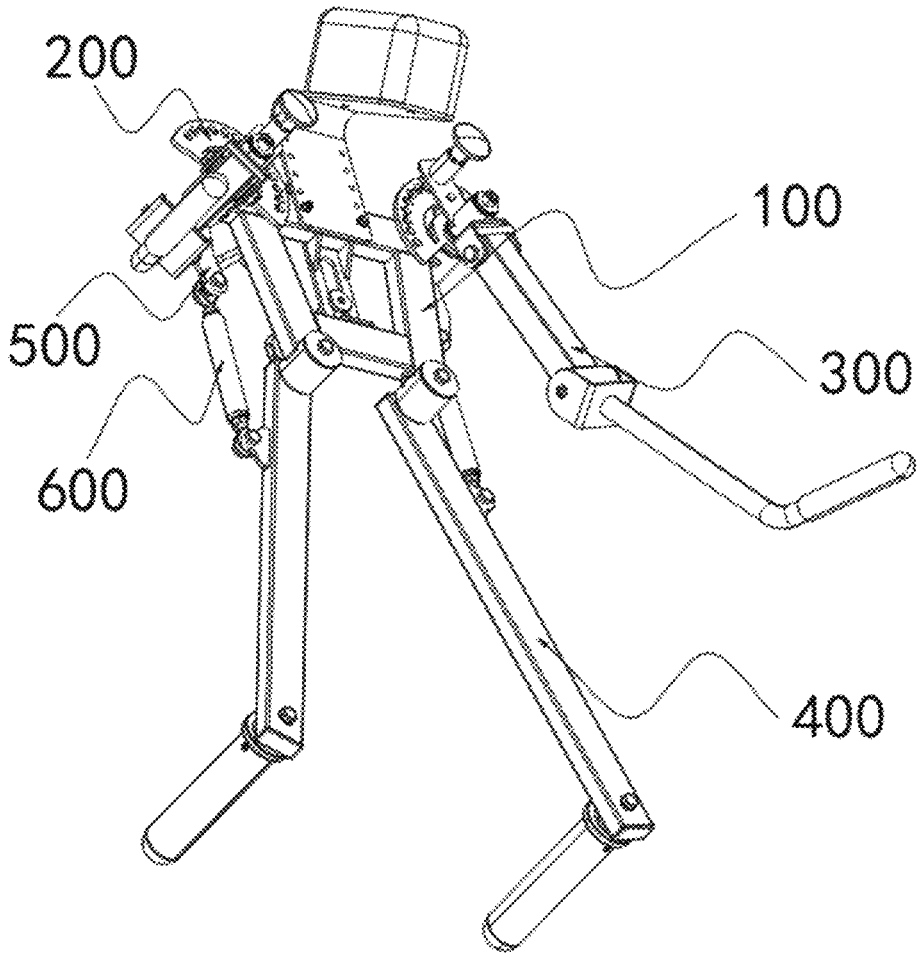
FIG. 1 is a perspective view of the present disclosure.

Reference signs: Frame (100); Adjustment mechanism (200); Rotating rod (201); Rotating drum (202); Connecting plate (203); Fixing sleeve (204); Spring (205); Pin (206); Connecting rod (2061); Handle (2062); Connection block (2063); Insertion rod (2064); Rotating disc (207); Socket (208); Mounting sleeve (209); Arc-shaped groove (210); Limit rod (211); Movement arm (300); First moving rod (301); Second moving rod (302); Grip handle (303); Weight arm (400); Weight bar (401); Weight rod (402); Rocker arm (500); Linkage rod (600).

DESCRIPTION OF EMBODIMENTS

The technical solution in the embodiment of the present disclosure will be clearly and completely described below with reference to the drawings. Obviously, the described embodiment is part of, rather than all of the embodiments of the present disclosure. The following description of at least one exemplary embodiment is illustrative in nature and is in no way intended to limit the present disclosure, its application or uses. Based on the embodiments in the present disclosure, all other embodiments obtained by those skilled in the art without creative work belong to the scope of protection of the present disclosure.

It should be noted that the terminology used here is only for describing specific embodiments, and is not intended to limit exemplary embodiments according to the present application. As used herein, the singular form is also intended to include the plural form unless the context clearly indicates otherwise. Furthermore, it should be appreciated that when the terms "comprising" and/or "including" are used in this specification, they specify the presence of features, steps, operations, devices, components and/or combinations thereof.

Unless otherwise specified, the relative arrangement of components and steps, numerical expressions and numerical values set forth in these embodiments do not limit the scope of the present disclosure. At the same time, it should be appreciated that for the convenience of description, the dimensions of various parts shown in the drawings are not drawn according to the actual scale relationship. Techniques, methods and equipment known to those skilled in the art may not be discussed in detail, but in appropriate cases, they should be regarded as part of the authorization specification. In all the examples shown and discussed herein, any specific values should be interpreted as illustrative, and not as limiting. Therefore, other examples of exemplary embodiments may have different values. It should be noted that similar numbers and letters indicate similar items in the following drawings, therefore once an item is defined in one drawing, it does not need to be further discussed in subsequent drawings.

Figure 2:
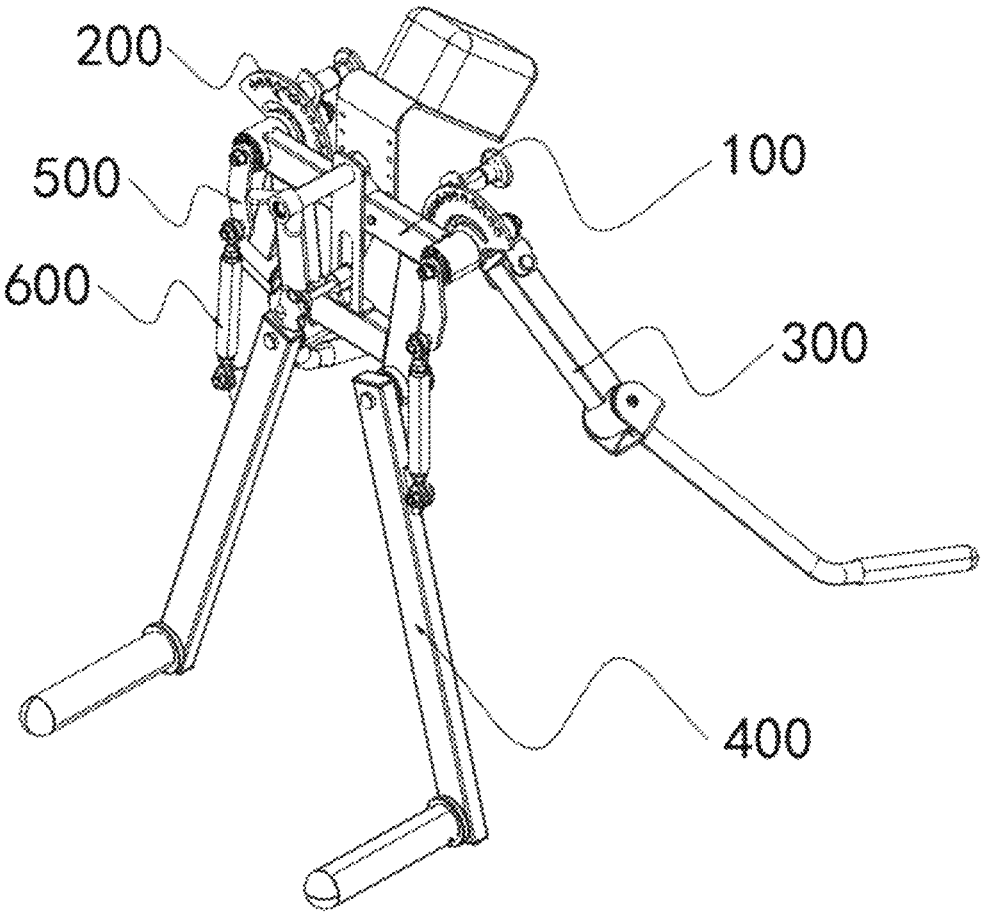
FIG. 2 is a perspective view of another side of the present disclosure.

Referring to FIGS. 1 and 2, the shoulder swing and chest press combination exercise machine includes a frame 100, which can be connected to a power rack; an adjustment mechanism 200, mounted on the frame 100; a movement arm 300, with one end connected to the adjustment mechanism 200; a weight arm 400, with one end hinged to the frame 100; a rocker arm 500, forming a linkage mechanism with the movement arm 300 through the adjustment mechanism 200, where the movement arm 300 and the rocker arm 500 achieve mode switching through the adjustment mechanism 200; and a linkage rod 600, with both ends hinged to the rocker arm 500 and the weight arm 400, respectively.

In other embodiments (not shown), the linkage rod 600 is designed as a telescopic or replaceable structure. By adjusting the length or connection point position of the linkage rod 600, the motion pattern can be altered, thereby generating different motion trajectories (such as horizontal push-pull, vertical swing, or diagonal movement) and expanding training areas (e.g., adding back or abdominal exercises).

Referring to FIGS. 4 to 8, the adjustment mechanism 200 includes a rotating disc 207, which is arc-shaped and positioned between the frame 100 and the movement arm 300; a rotating rod 201, with one end passing through the rotating disc 207 and connected to the rocker arm 500, while the other end connected to the movement arm 300, where when the movement arm 300 rotates, it drives the rocker arm 500 to rotate via the rotating rod 201; a plug-in assembly located on the side of the rotating disc 207 away from the frame 100 and connected to the rotating rod 201. The plug-in assembly can selectively fix the connection position with the rotating disc 207, allowing adjustment of the angle between the movement arm 300 and the weight arm 400 to switch between the shoulder swing motion mode and the chest press motion mode.

When the movement arm 300 rotates around the axis of the rotating rod 201, it drives the rocker arm 500 to move in unison. As the movement arm 300 rotates, the rotating rod 201 causes the rocker arm 500 to rotate together, thereby driving the weight arm 400 to rotate via the linkage rod 600.

The adjustment mechanism 200 further includes a rotating drum 202, which is sleeved outside the rotating rod 201 and connected at one end to the movement arm 300; a connecting plate 203 arranged at one end of the rotating drum 202, with the plug-in assembly positioned at the other end of the connecting plate 203. The angle of the plug-in assembly is adjusted by rotating the rotating drum 202.

The adjustment mechanism 200 further includes an arc-shaped groove 210, which is formed on the surface of the rotating disc 207, and a limit rod 211, which is positioned on the side of the connecting plate 203 close to the rotating disc 207. The limit rod 211 is slidably connected to the arc-shaped groove 210, with one end positioned between the rotating rod 201 and the plug-in assembly, and the other end movably placed within the arc-shaped groove 210 on the surface of the rotating disc 207 for limiting the connection position between the plug-in assembly and the rotating disc 207, ensuring the movement arm 300 rotates within a defined range.

A plurality of sockets 208 are evenly distributed on the circumferential edge of the rotating disc 207. The plug-in assembly can selectively engage with any of these sockets 208. By inserting the plug-in assembly into different sockets 208, the movement arm 300 can fix the angle relative to the weight arm 400, enabling either shoulder swing or chest press motions based on the position where the plug-in assembly is inserted into the socket.

The edge of the disc face of the rotating disc 207 is marked with angle scale markings. The sockets 208 are uniformly spaced at 15°-20° intervals to form angle positioning points, with each scale marking corresponding to a socket 208. Adjustments can be made by selecting sockets 208 at different angles as needed.

The axes of the arc-shaped groove 210, the rotation center of the rotating disc 207, and the motion trajectory of the movement arm 300 coincide, ensuring synchronization between the rotation of the rotating disc 207 and the movement of the movement arm 300 along the arc-shaped groove 210, eliminating trajectory deviation caused by axis misalignment.

In other embodiments (not shown), the single-layer fixed rotating disc 207 is replaced with a multi-layer nested rotating disc 207, with each layer featuring sockets 208 distributed at different angles. Rotating the multi-layer discs 207 that are stacked together generates more socket 208 combinations, providing finer angle adjustments (e.g., in 5° increments).

The plug-in assembly includes a fixing sleeve 204 installed within the connecting plate 203. One end of the fixing sleeve 204 is equipped with a mounting sleeve 209, inside which a pin 206 is slidably inserted. A spring 205 is sleeved outside the pin 206 to reset the pin 206. In a linkage mode, when the pin 206 is inserted into the socket 208 and locked, the user pushes or pulls the movement arm 300 to drive the weight arm 400, generating dynamic resistance. By switching the positions of the sockets 208, the angle between the movement arm 300 and the weight arm 400 can be adjusted to achieve the arc-shaped trajectories for shoulder swing motion and chest press motion, respectively. In a separation mode, pulling out the pin 206 allows the movement arm 300 to move independently.

In other embodiments (not shown), the manual pin 206 is replaced with an electric pin 206 driven by a micro motor. The user selects the mode via a touchscreen or voice command, and the motor automatically pushes the pin 206 into the target socket 208, enabling "one-click switching" of training modes for enhanced operational convenience.

In other embodiments (not shown), an electromagnet is embedded in the socket 208, and the head of the pin 206 is made of magnetic material. When powered, the pin 206 automatically locks via magnetic attraction, and releases when power is cut off, avoiding wear and jamming issues associated with traditional mechanical pins 206.

The pin 206 includes a connecting rod 2061, a handle 2062, a connection block 2063, and an insertion rod 2064. The connecting rod 2061 is slidably inserted into the mounting sleeve 209. The connection block 2063 and the handle 2062 are fixedly connected to the two ends of the connecting rod 2061, respectively. The insertion rod 2064 is fixed to the other end of the connection block 2063 and slidably inserted into the socket 208. The spring 205 is sleeved on the outer side of the connecting rod 2061, with its two ends abutting against the connection block 2063 and the mounting sleeve 209, respectively. By pulling the handle 2062, the connecting rod 2061, connection block 2063, and insertion rod 2064 move together, compressing the spring 205 and causing the insertion rod 2064 to move away from the socket 208. This allows adjustment of the angle between the movement arm 300 and the rocker arm 500. After adjustment, the handle 2062 is released to cause the insertion rod 2064 to reset under the elastic force of the spring 205, allowing the insertion rod 2064 is inserted into the socket 208 to be locked. When the pin 206 is inserted into different sockets 208, the angle between the movement arm 300 and the weight arm 400 changes, altering the motion trajectory of the movement arm 300 to achieve either a shoulder swing motion or a chest press motion. When the pin 206 is pulled out, the movement arm 300 disengages from the adjustment mechanism 200 and moves independently.

Figure 3:
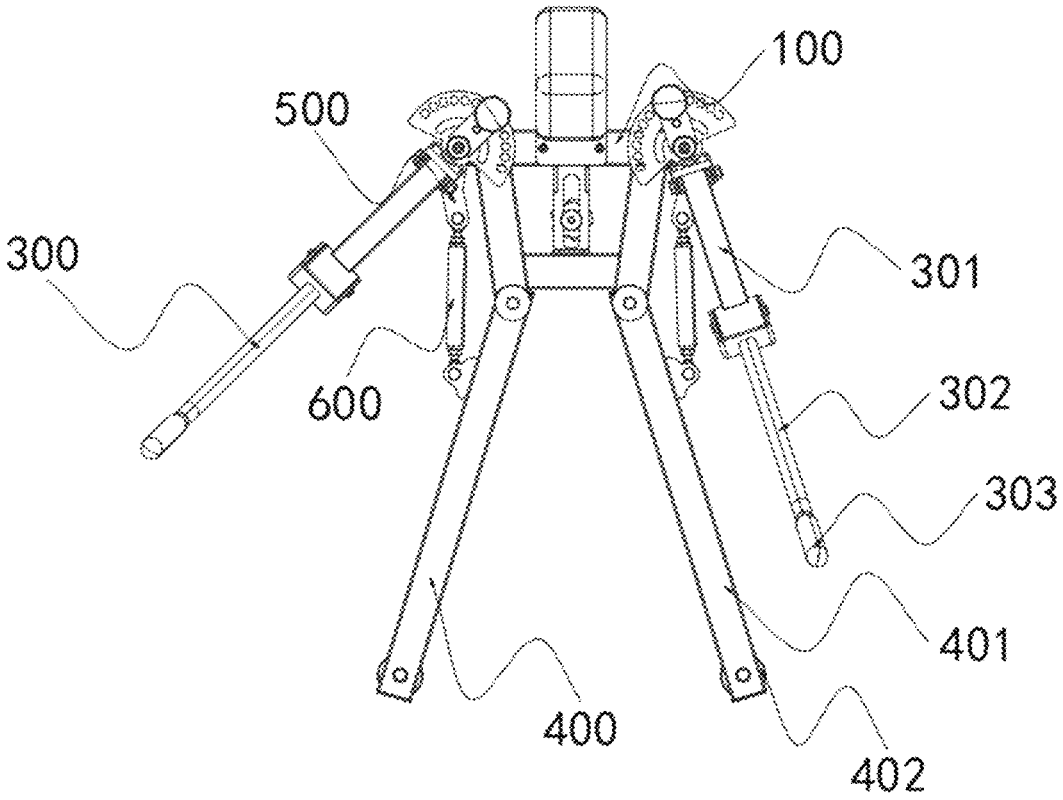
FIG. 3 is a front structural schematic view of the present disclosure.
Figure 4:
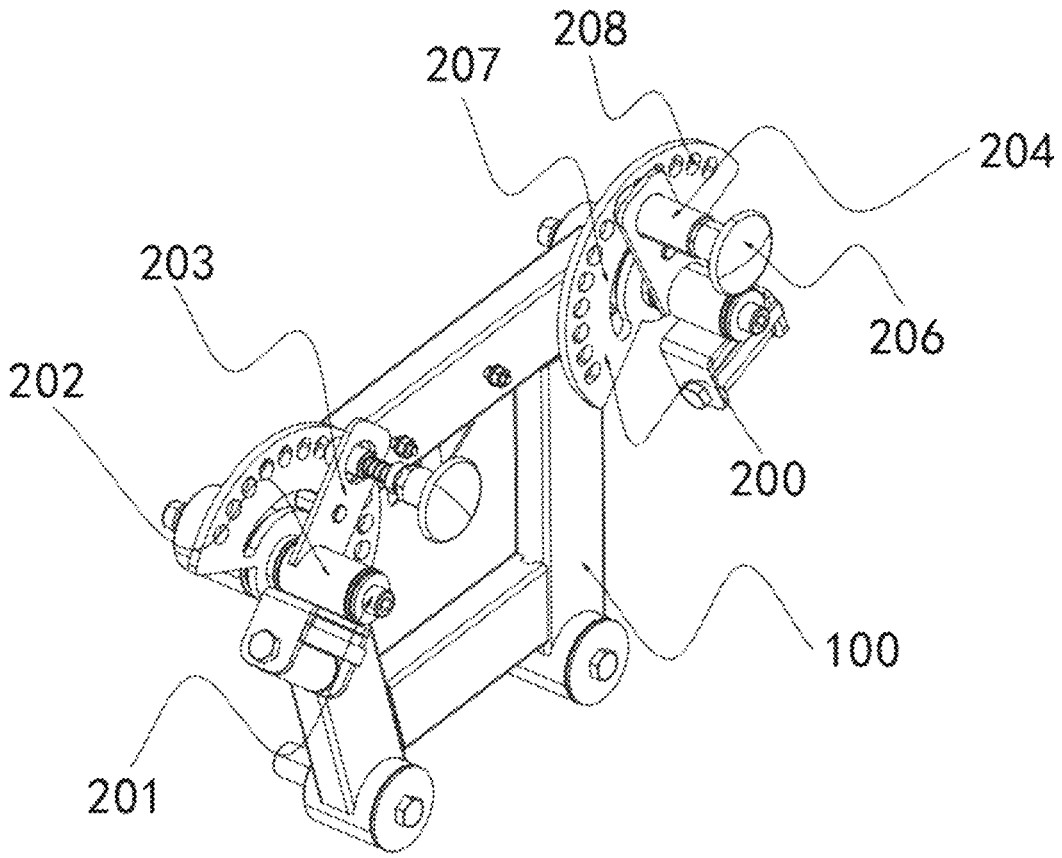
FIG. 4 is a structural schematic view of the adjustment mechanism.
Figure 5:
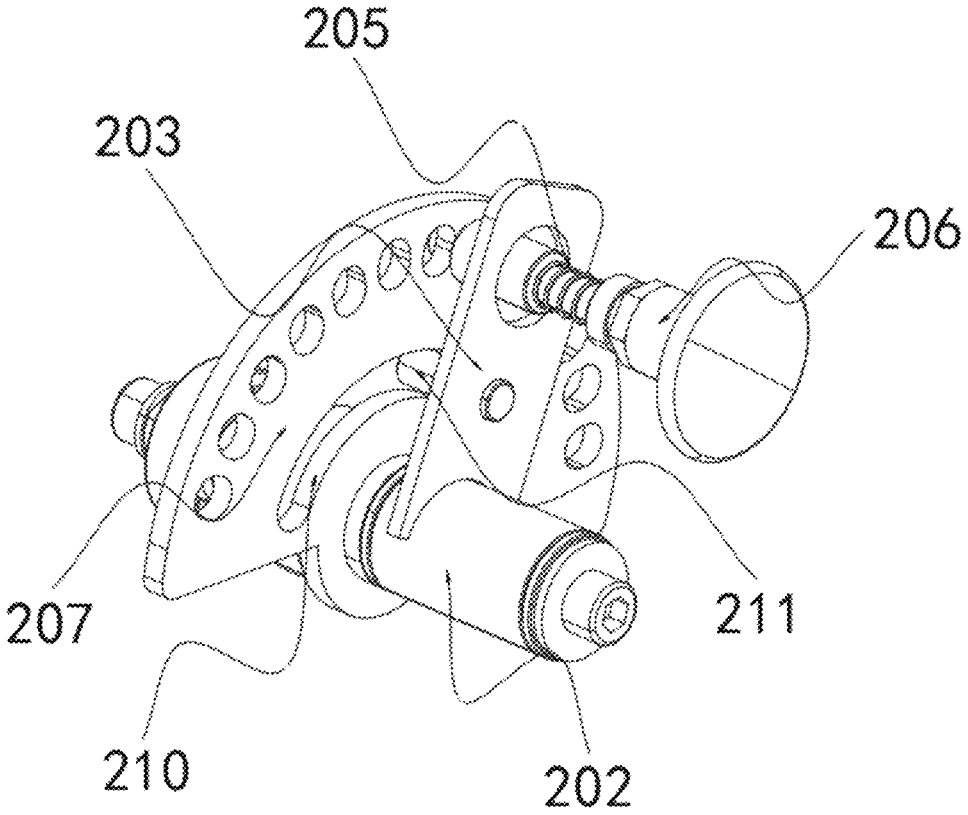
FIG. 5 is a structural schematic view of the spring and pin.
Figure 6:
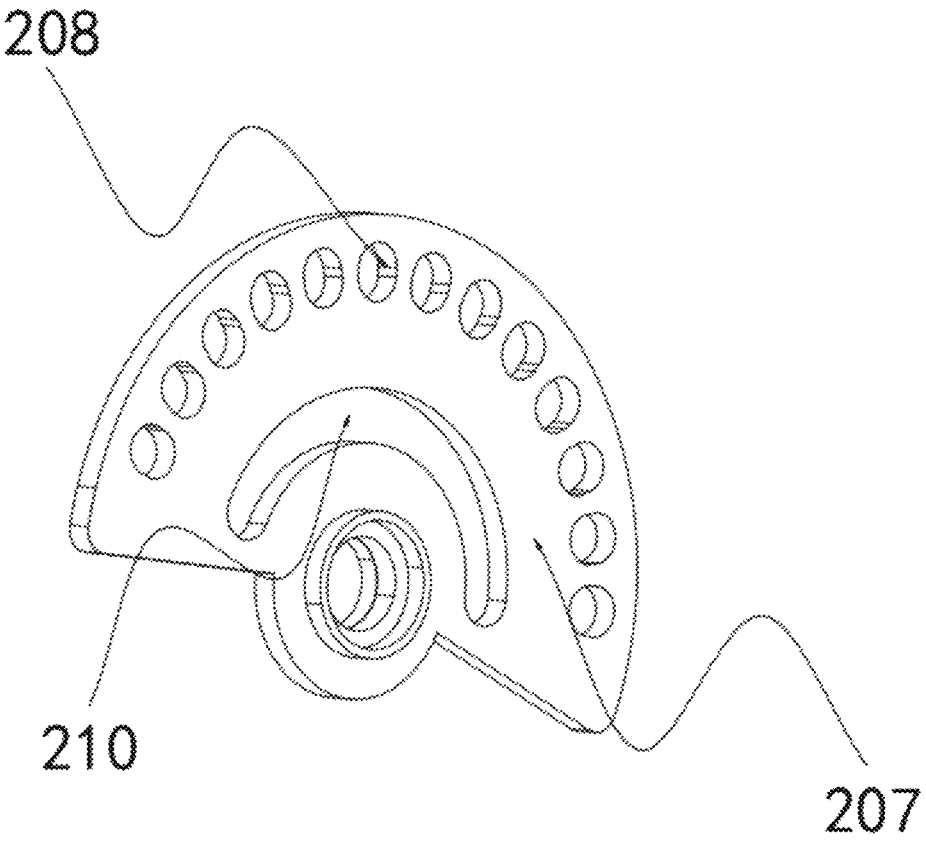
FIG. 6 is a structural schematic view of the rotating disc and sockets.
Figure 7:
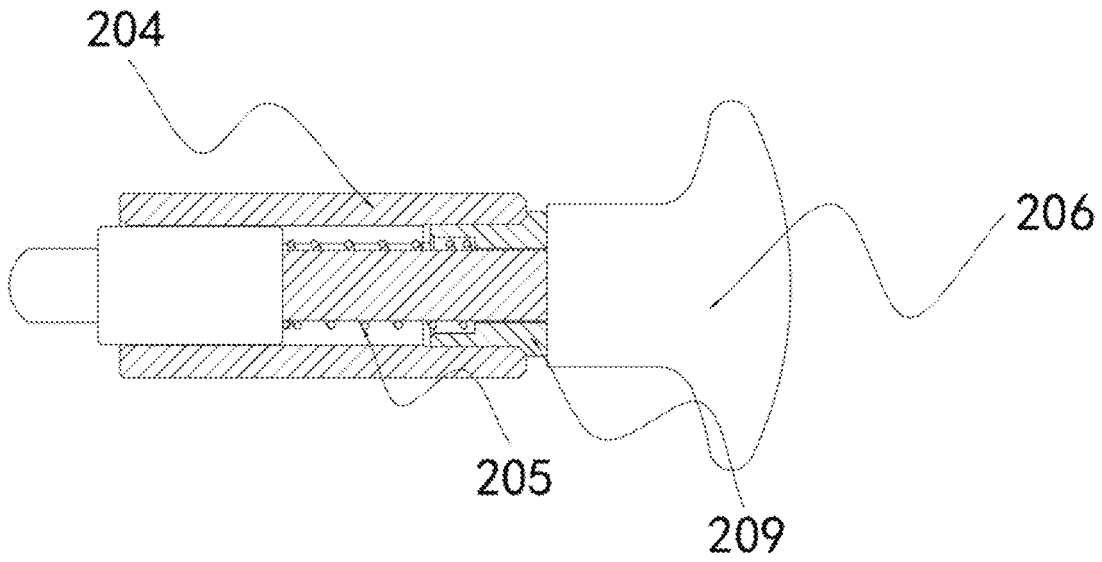
FIG. 7 is a structural schematic view of the fixing sleeve, spring, pin, and mounting sleeve.
Figure 8:
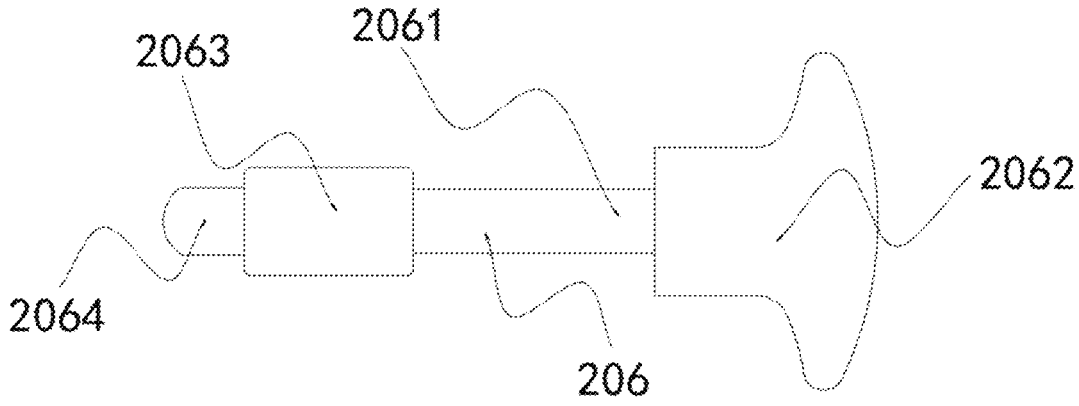
FIG. 8 is a structural schematic view of the pin.

Referring to FIGS. 1 to 3, the movement arm 300 is maintained at a first angle or a second angle relative to the weight arm 400 via the plug-in assembly. When the movement arm 300 is at the first angle, a shoulder swing motion can be performed. When the movement arm 300 is at the second angle, a chest press motion can be performed.

Specifically, when the angle between the movement arm 300 and the weight arm 400 is −30° to 30°, the pin 206 forms the first angle with the weight arm 400, enabling the shoulder swing motion. When the angle between the movement arm 300 and the weight arm 400 exceeds 30°, the pin 206 forms the second angle with the weight arm 400, enabling the chest press motion.

When the movement arm 300 is at the first angle, as the movement arm 300 lifts outward and upward, the weight arm 400 is synchronously driven to lift upward via the linkage rod 600, achieving the shoulder swing motion.

When the movement arm 300 is at the second angle, as the movement arm 300 lifts outward and downward, the weight arm 400 is synchronously driven to lift upward via the linkage rod 600, achieving the chest press motion.

The weight arm 400 includes a weight bar 401 and a weight rod 402. The weight bar 401 is hinged to the frame 100. The weight rod 402 is arranged at one end of the weight bar 401 for mounting weight blocks. By adding or removing weight blocks on the weight rod 402, the load on the weight bar 401 during motion can be adjusted, thereby modifying the effectiveness of the two exercise modes: shoulder swing and chest press.

In specific implementations, when the pin 206 is inserted into any socket 208 away from the frame 100, the angle between the movement arm 300 and the weight arm 400 ranges from −30° to 30°, enabling a shoulder swing motion. When the pin 206 is inserted into any socket 206 close to the frame 100, the angle between the movement arm 300 and the weight arm 400 exceeds 30°, allowing a chest press motion.

The movement arm 300 includes a first moving rod 301, a second moving rod 302, and a grip handle 303. The first moving rod 301 is fixedly connected to the rotating drum 202, the second moving rod 302 is hinged to the first moving rod 301, and the grip handle 303 is mounted at one end of the second moving rod 302 for hand gripping. The hinge between the first moving rod 301 and the second moving rod 302 allows adjustment of the angle of the second moving rod 302 as needed, ensuring a more comfortable grip on the handle 303.

The weight arm 400 includes a weight bar 401 and a weight rod 402. The weight bar 401 is hinged to the frame 100, and the weight rod 402 is mounted at one end of the weight bar 401 for hanging stacked weight plates. When the user pushes or pulls the movement arm 300, the motion is transmitted through the adjustment mechanism 200, driving the weight arm 400 to perform an arcuate lifting motion, while the weight rod 402 generates dynamic resistance under gravity.

In other embodiments (not shown), a hydraulic damper is added to the end of the weight arm 400. The hydraulic resistance is controlled by adjusting the valve, and with the combination with the gravitational resistance of the weight rod 402, a hybrid mode of linear resistance (gravity-dominant) and nonlinear resistance (hydraulic-dominant) is achieved, catering to different needs for explosive power and endurance training.

In other embodiments (not shown), the weight rod 402 is replaced with a combination of an electromagnet and a copper disc. When the user slides the weight arm 400, the electromagnetic field strength is adjusted by changing the current intensity, generating contactless variable resistance, and supporting remote resistance level adjustment via an APP.

In summary, the present disclosure achieves the following technical effects:

When the pin 206 is locked into a socket 208 on the rotating disc 207, the movement arm 300, rocker arm 500, linkage rod 600, and weight arm 400 form a four-rod linkage mechanism. When the user pushes or pulls the movement arm 300, the motion is transmitted through the four-rod linkage mechanism, driving the weight arm 400 to perform an arcuate motion, while the weight rod 402 generates dynamic resistance under gravity. By adjusting the insertion position of the pin 206 into sockets 208 at different positions on the rotating disc 207, the angle between the movement arm 300 and the weight arm 400 can be altered, thereby changing the motion trajectory of the movement arm 300 to achieve either a shoulder swing or chest press motion. When the pin 206 is removed, the movement arm 300 disengages from the linkage mechanism for independent movement.

The multi-angle sockets 208 on the rotating disc 207 of the rotating rod 201 engage with the pin 206. By inserting the pin into different sockets 208, the mode can be quickly switched between shoulder swing and chest press without tools or complex operations, enabling rapid transition between the two training modes. Resistance is transmitted through rigid connections, ensuring precise matching of resistance and motion trajectory in both modes. During shoulder swing or chest press mode, the arcuate motion of the rocker arm 500 drives the weight arm 400 via the linkage rod 600 to generate progressive resistance.

The application of the present disclosure not only meets users' needs for switching between shoulder swing and chest press modes but also greatly simplifies the switching process, enhancing the market competitiveness and user satisfaction of the shoulder swing and chest press combination exercise machine. Through the implementation of the above technical solution, the shoulder swing and chest press combination exercise machine of the present disclosure achieves a more compact and rational structure while significantly improving performance, providing fitness enthusiasts with a more efficient, safe, and comfortable user experience.

In summary, the application and expansion of this technical solution can significantly enhance the functionality and practicality of various fitness equipment, effectively meeting the diverse needs of fitness enthusiasts across different training programs, and thus holds high value for widespread adoption.

In the description of the present disclosure, it should be appreciated that directional terms such as "front, rear, up, down, left, right", "horizontal, vertical, perpendicular, horizontal" and "top, bottom" etc. indicate the orientation or positional relationship based on the orientation or positional relationship shown in the drawings, and are only for the convenience of describing the present disclosure and simplifying the description. In the absence of a contrary explanation, these directional terms do not indicate or imply that the device or element referred to must have a specific orientation or be constructed and operated in a specific orientation, and therefore should not be understood as limiting the scope of protection of the present disclosure; the directional terms "inside, outside" refer to the inside and outside relative to the contour of each component itself.

For the convenience of description, spatial relative terms such as "on . . . ", "above . . . ", "on the upper surface of . . . ", "upper" etc. may be used here to describe the spatial positional relationship of a device or feature with other devices or features as shown in the drawings. It should be appreciated that spatial relative terms are intended to encompass different orientations of the device in use or operation other than the orientation described in the drawings. For example, if the device in the drawing is inverted, the device described as "above other devices or structures" or "on other devices or structures" will subsequently be positioned as "below other devices or structures" or "under other devices or structures". Thus, the exemplary term "above" can include both "above" and "below" orientations. The device can also be positioned in other different ways (rotated 90 degrees or in other orientations), and the spatial relative descriptions used here should be interpreted accordingly.

In addition, it should be noted that the use of terms such as "first", "second" etc. to define components is for the convenience of distinguishing the corresponding components. Unless otherwise stated, the above terms have no special meaning, and therefore should not be understood as limiting the scope of protection of the present disclosure.

The above description is only a preferred embodiment of the present disclosure and is not intended to limit the present disclosure. For those skilled in the art, the present disclosure can have various modifications and changes. Any modifications, equivalent replacements, improvements etc. made within the spirit and principles of the present disclosure should be included within the scope of protection of the present disclosure.

What is claimed is:

1. A shoulder swing and chest press combination exercise machine, comprising a frame;

an adjustment mechanism disposed on the frame;

a movement arm, one end of which is connected to the adjustment mechanism;

a weight arm, one end of which is hinged to the frame;

a rocker arm, which forms a linkage mechanism with the movement arm through the adjustment mechanism; and a linkage rod, both ends of which are hinged to the rocker arm and the weight arm, respectively.

2. The shoulder swing and chest press combination exercise machine according to claim 1, wherein the adjustment mechanism comprises: a rotating disc disposed between the frame and the movement arm;

a rotating rod, one end of which passes through the rotating disc and is connected to the rocker arm, and the other end of which is connected to the movement arm; and a plug-in assembly located on a side of the rotating disc away from the frame and connected to the rotating rod, wherein the plug-in assembly selectively fixes a connection position with the rotating disc; and wherein when the movement arm rotates about an axis of the rotating rod, the rocker arm is driven to move in linkage.

3. The shoulder swing and chest press combination exercise machine according to claim 2, wherein the adjustment mechanism further comprises:

a rotating drum sleeved outside the rotating rod, with one end being connected to the movement arm; and a connecting plate disposed at one end of the rotating drum, with the plug-in assembly disposed at the other end of the connecting plate.

4. The shoulder swing and chest press combination exercise machine according to claim 3, wherein the adjustment mechanism further comprises:

an arc-shaped groove formed on a surface of the rotating disc; and a limit rod arranged on a side of the connecting plate close to the rotating disc, wherein the limit rod is slidably connected to the arc-shaped groove.

5. The shoulder swing and chest press combination exercise machine according to claim 3, wherein the plug-in assembly comprises a fixing sleeve arranged inside the connecting plate, with one end of the fixing sleeve provided with a mounting sleeve, and a pin slidably inserted inside the mounting sleeve, and a spring is sleeved outside the pin.

6. The shoulder swing and chest press combination exercise machine according to claim 2, wherein a plurality of sockets are uniformly distributed on a circumferential edge of the rotating disc, and the plug-in assembly selectively engages with any of the sockets.

7. The shoulder swing and chest press combination exercise machine according to claim 6, wherein an edge of a disc face of the rotating disc is provided with angle scale markings, and the sockets are uniformly distributed at 15°-20° intervals to form angle positioning points, with the scale markings corresponding one-to-one with the sockets.

8. The shoulder swing and chest press combination exercise machine according to claim 2, wherein the movement arm is maintained at a first angle or a second angle with the weight arm via the plug-in assembly, wherein when the movement arm is at the first angle, a shoulder swing motion can be performed, while when the movement arm is at the second angle, a chest press motion can be performed.

9. The shoulder swing and chest press combination exercise machine according to claim 7, wherein when the movement arm is at the first angle, as the movement arm lifts outward and upward, the movement arm synchronously drives the weight arm to lift upward via the linkage rod, achieving the shoulder swing motion; and when the movement arm is at the second angle, as the movement arm lifts outward and downward, the movement arm synchronously drives the weight arm to lift upward via the linkage rod, achieving the chest press motion.

10. The shoulder swing and chest press combination exercise machine according to claim 1, wherein the weight arm comprises a weight bar hinged to the frame and a weight rod arranged at one end of the weight bar.

11. A shoulder swing and chest press combination exercise machine, comprising a frame;

an adjustment mechanism arranged on the frame;

a movement arm, one end of which is connected to the adjustment mechanism;

a weight arm, one end of which is hinged to the frame;

a rocker arm, forming a linkage mechanism with the movement arm through the adjustment mechanism;

a linkage rod, both ends of which are hinged to the rocker arm and the weight arm respectively;

wherein the adjustment mechanism comprises a rotating disc arranged between the frame and the movement arm; and a rotating rod, one end of which passes through the rotating disc and is connected to the rocker arm, and the other end of which is connected to the movement arm; and a plug-in assembly, located on a side of the rotating disc away from the frame and connected to the rotating rod, wherein the plug-in assembly selectively fixes a connection position with the rotating disc.

12. The shoulder swing and chest press combination exercise machine according to claim 11, wherein the adjustment mechanism further comprises:

a rotating drum sleeved outside the rotating rod, with one end connected to the movement arm;

a connecting plate arranged at one end of the rotating drum, with the plug-in assembly arranged at the other end of the connecting plate;

an arc-shaped groove formed on a surface of the rotating disc; and a limit rod arranged on a side of the connecting plate close to the rotating disc, wherein the limit rod is slidably connected to the arc-shaped groove.

13. The shoulder swing and chest press combination exercise machine according to claim 11, wherein a plurality of sockets are uniformly distributed on a circumferential edge of the rotating disc, and the plug-in assembly selectively engages with any of the sockets.

14. The shoulder swing and chest press combination exercise machine according to claim 13, wherein an edge of the disc face of the rotating disc is provided with angle scale markings, and the sockets are uniformly distributed at 15°-20° intervals to form angle positioning points, with the angle scale markings corresponding one-to-one with the sockets.

15. The shoulder swing and chest press combination exercise machine according to claim 11, wherein the plug-in assembly comprises a fixing sleeve arranged inside the connecting plate, with one end of the fixing sleeve provided with a mounting sleeve, and a pin slidably inserted inside the mounting sleeve, and a spring is sleeved outside the pin.

16. The shoulder swing and chest press combination exercise machine according to claim 11, wherein the movement arm is maintained at a first angle or a second angle with the weight arm through the plug-in assembly, wherein when the movement arm is at the first angle, a shoulder swing motion can be performed, while when the movement arm is at the second angle, a chest press motion can be performed.

17. The shoulder swing and chest press combination exercise machine according to claim 16, wherein when the movement arm is at the first angle, as the movement arm lifts outward and upward, the weight arm is synchronously driven upward through the linkage rod to achieve the shoulder swing motion; and when the movement arm is at the second angle, as the movement arm lifts outward and downward, the weight arm is synchronously driven upward through the linkage rod to achieve the chest press motion.

18. The shoulder swing and chest press combination exercise machine according to claim 11, wherein the weight arm comprises a weight bar hinged to the frame and a weight rod arranged at one end of the weight bar.

19. A shoulder swing and chest press combination exercise machine, comprising a frame;

an adjustment mechanism arranged on the frame;

a movement arm, one end of which is connected to the adjustment mechanism;

a weight arm, one end of which is hinged to the frame;

a rocker arm, forming a linkage mechanism with the movement arm through the adjustment mechanism;

a linkage rod, both ends of which are hinged to the rocker arm and the weight arm respectively;

wherein, the adjustment mechanism comprises a rotating disc arranged between the frame and the movement arm;

a rotating rod, one end of which passes through the rotating disc and is connected to the rocker arm, and the other end of which is connected to the movement arm;

a plug-in assembly, located on a side of the rotating disc away from the frame and connected to the rotating rod, wherein the plug-in assembly selectively fixes a connection position with the rotating disc; and a limit rod, one end of which is arranged between the rotating rod and the plug-in assembly, and the other end of which is movably arranged in an arc-shaped groove on a surface of the rotating disc for limiting a connection position between the plug-in assembly and the rotating disc.

20. The shoulder swing and chest press combination exercise machine according to claim 19, wherein axes of the arc-shaped groove, a rotation center of the rotating disc, and a motion trajectory of the movement arm coincide.

* * * * *